United States Patent [19]

Donaghy

[11] 3,981,310

[45] Sept. 21, 1976

[54] MOLDED BRASSIERE CUPS

[75] Inventor: James G. Donaghy, Flanders, N.J.

[73] Assignee: International Playtex, Inc., New York, N.Y.

[22] Filed: Jan. 22, 1975

[21] Appl. No.: 542,995

[52] U.S. Cl. ..... 128/464; 66/195; 128/517

[51] Int. Cl.[2] ..... A41C 3/00

[58] Field of Search ..... 66/195, 192, 175, 176; 128/425, 463, 464, 516, 517

[56] References Cited

UNITED STATES PATENTS

| | | | |
|---|---|---|---|
| 2,191,545 | 2/1940 | Schneider | 128/464 |
| 2,285,967 | 6/1942 | Hardy | 128/464 X |
| 2,616,084 | 11/1952 | Shearer | 128/464 |
| 3,101,717 | 8/1963 | Korman | 128/463 |
| 3,202,565 | 8/1965 | Loftin | 128/463 X |
| 3,434,478 | 3/1969 | Liebowitz et al. | 128/463 |

OTHER PUBLICATIONS

Paling, D. F., Warp Knitting Technology, Manchester, England, Columbine Press Ltd., 1965, Chapt. 8, pp. 144–161.

*Primary Examiner*—Werner H. Schroeder
*Attorney, Agent, or Firm*—Stewart J. Fried; Jeffrey A. Schwab; Morris Reinisch

[57] ABSTRACT

A brassiere having breast cups molded from a heat settable, thermoplastic fabric, such as polyester, of warp knit construction and including top, middle and bottom guide bar yarns. The bottom and/or middle guide bar yarns have a denier per filament of at least 10. The stitch construction is particularly selected so that the bottom and middle guide bars run in opposition to each other and each have an underlap length which extends between at least two wales. Preferably, the stitch configuration of the bottom guide bar should be 1-0/1-2 and the middle guide bar should be 1-2/1-0. Alternatively, a stitch configuration of 1-0/2-3 may be employed in the bottom guide bar and 2-3/1-0 in the middle guide bar. The top guide bar primarily controls the aesthetics of the fabric and preferably may have a stitch configuration of 1-0/2-3 or, alternatively, a stitch configuration of 1-0/3-4. The molded bra cups have excellent shape retention properties, especially after repeated washings.

7 Claims, 9 Drawing Figures

Figure 3A:
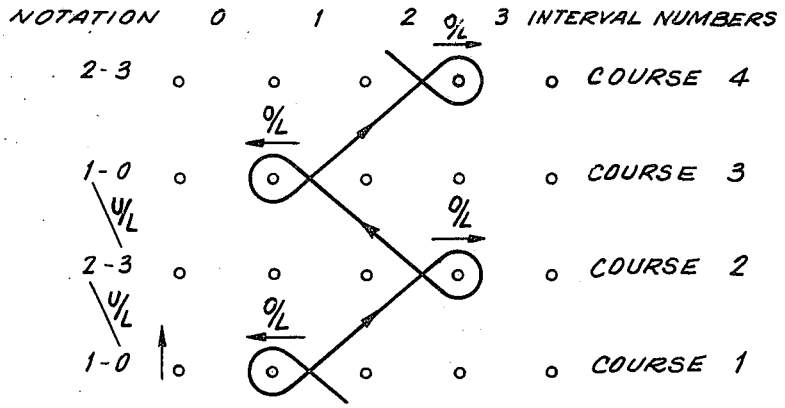

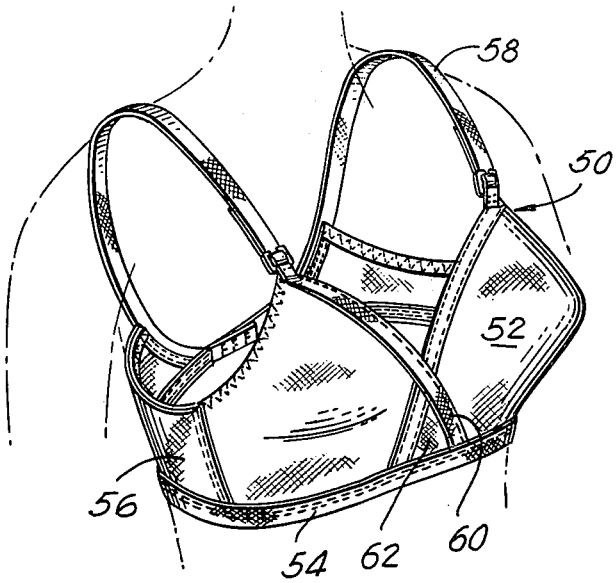
FIG. 1
FIG. 2A
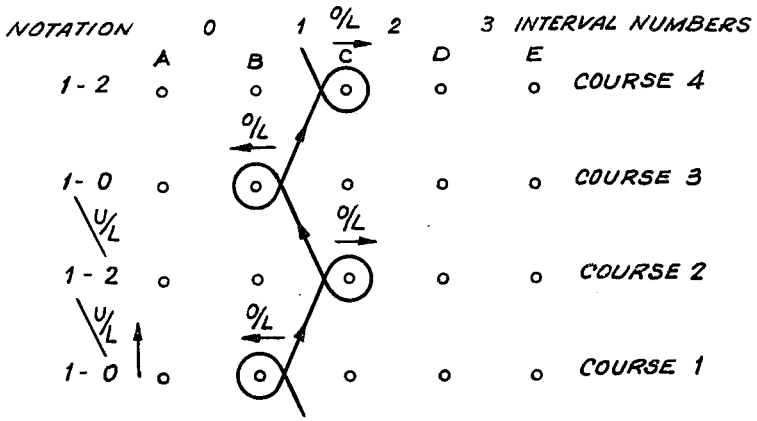
FIG. 2B
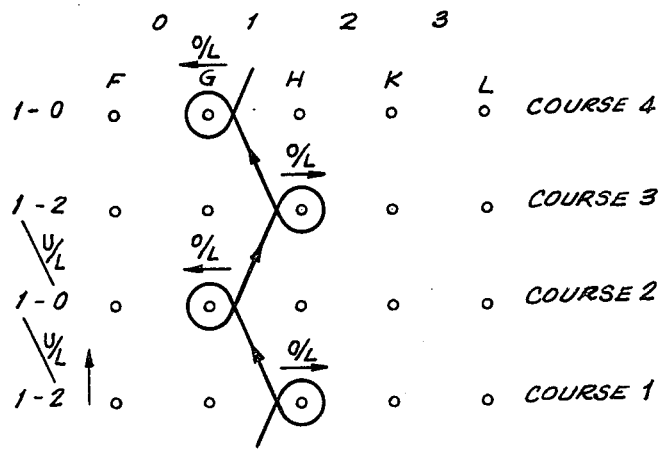

MOLDED BRASSIERE CUPS

The present invention relates generally to the type of brassiere in which each of the cups is molded from a single piece of planar fabric into the desired three-dimensional configuration and, in particular, to such molded cups which are constructed of a fabric to yield surprisingly improved wear characteristics.

Conventionally, bra cups are made by cutting planar fabric into a plurality of appropriate pieces, which are then sewn together to form a three-dimensional bra cup, which is then sewn into a brassiere frame by standard techniques. Such a brassiere having cut-and-sewn cups is typically shown in U.S. Pat. No. 3,817,255. Cut-and-sewn bra cups can be made to perform very well with respect to shape retention and support after wearing and washing. For example, cut-and-sewn bra cups are known to successfully withstand over 100 launderings and still retain their shape and other required performance characteristics.

However, such cut-and-sewn bra cups have seam lines which may tend to show as ridges through fine outerwear and the degree of curvilinear shape which may be imparted to the cup is limited. Many of today's fashions demand a natural and smooth breast contour without such artificial seam lines.

It has therefore long been desirable to produce commercially acceptable molded bra cups providing comfort to the wearer, permanence of form or shape retention, washability, durability, strength, softness and flexibility, breathability and smoothness. While there have been numerous prior art attempts to produce such molded bra cups, a commercially acceptable product has not been produced having all these characteristics with the long wearing and washing life characteristics of cut-and-sewn bra cups.

Early attempts to produce molded bra cups typically involved molding nylon fabric. However, with nylon it is difficult to override the partial heat set which is applied when the fabric is produced. As a result, when nylon fabrics are molded and heat set, it is necessary to approach the melting point of the nylon in order to override the partial heat set, resulting in a high incidence of yellowing and the fabric becoming brittle. This has made nylon commercially undesirable for molding bra cups. The advent of polyester fabrics has done much to overcome this problem. The partial heat set applied to polyester fabric when it is produced can be easily overriden by only a relatively small increase in the temperature at which the bra cup is molded (e.g., about 20° above the partial heat set temperature).

While the industry has adopted polyester fabrics as the basic constituent in molded bra cups, the use of polyester fabrics per se does not solve all the problems of bra cup molding. Many polyester fabrics presently employed do not have the basic characteristics which enable it to have good three-dimensional drapability without resulting in a cup which readily loses support after molding. These fabrics in the planar state have too high a degree of stretch. While such fabrics will drape and conform well to the three-dimensional mold, the bra cup which is formed oftentimes retains too much stretch after molding. The weight of the breast causes the cup to distend with a resultant loss of support and uplift. Repeated washing and wearing also causes a like loss of support and uplift. The degre of stretch of such fabrics is not limited sufficiently so that the finished brassiere cup will retain its shape and provide sufficient breast support after molding and repeated wearing and laundering.

It has also been found that even in brassiere cups molded from fabrics having a lesser degree of stretch, that problems of support can still arise since molding merely stabilizes the yarn but does not remove the slack from the yarn between stitches.

For example, it has been found that woven fabrics, even of polyester, do not have good molding characteristics as they have ends and picks at substantially right angles to one another. When such woven fabrics are molded, serious imperfections are caused by the shifting of ends and picks since all the interstices are not bound. In a woven fabric the yarns simply lay over and under each other and when molded into bra cups they become sleazy at the apex and lose integrity at the periphery or base. This is true even if the yarns have been selected for optimum stretch characteristics.

In order to overcome this problem, it has been suggested that a knitted rather than a woven fabric be employed, and that a heat shrinkable yarn be used, so that in molding any slack between stitches would be eliminated. However launderability problems result, since the heat of conventional household dryers oftentimes causes additional shrinkage of the yarn to take place. The problem of shape loss after many launderings was not overcome.

Because of the great interest in the corsetry industry in molded cups many other attempts to meet this problem have been made using a variety of yarn combinations and even using laminated fabrics. A typical example can be found in a molded bra cup widely used in the industry today. It employs two layers of a two-bar, warp knit jersey fabric employing 40 denier multi-filament polyester yarns in both guide bars with the fabrics laminated back to back. Even with the lamination of two fabrics together a relatively high degree of stretch of the multi-filament yarns is retained and it has been found that bra cups molded from such fabric have had poor shape retention after only about 25 launderings. U.S. Pat. No. 2,616,084 to H. E. Shearer typically shows such a molded brassiere cup of two-bar, warp knit jersey fabric.

It has even been suggested that fabrics of monofilament yarns be employed. However, because of the inherent stiffness of monofilament yarns as compared to multifilament yarns, an undesirable hand or feel was imparted to the finished brassiere cups, which is especially undesirable when the sensitive nature of a woman's breasts is considered. U.S. Pat. No. 3,070,870 to N. J. Alexander and U.S. Pat. No. 3,434,478 to B. Liebowitz are examples of molded bra cups employing such monofilament yarns. However, as was recognized in the Alexander patent, because the monofilament yarns are relatively coarse, they should be employed only as an intermediate layer between two masking outer layers. Thus this requires a three-layer laminate as the basic molding package. Such three-layer laminates can be costly and undesirably stiff.

Accordingly, the long desired objectives of producing molded bra cups that had stretch characteristics relatively easy to mold, a good hand for comfort, had limited residual stretch after molding, and good shape retention after repeated launderings were not obtained. Each compensating step taken to correct a negative characteristic seemed to result in imparting a different negative characteristic. Even with the extremely high interest in the industry to meet these objectives the problem remained unsolved.

The present invention has solved this problem through the discovery of a basic fabric construction which meets all of the above objectives without the interaction of the constituents negatively affecting each other. The molded brassiere cup of the present invention is soft, comfortable and retains its shape after extensive wear. In wear and wash testing such molded bra cups have outperformed the 100 to 125 washings of typical cut-and-sewn bra cups. The molded bra cups of the present invention have been found to maintain their integrity and retain their shape after 175 machine launderings — an unexpected result and a vast improvement over prior art molded bra cups which did not retain their shape or which lost support after approximately 25 launderings.

The fabric is a heat settable, thermoplastic fabric, such as polyester, of warp knit construction knitted on at least three guide bars, generally referred to as top, middle and bottom guide bars. The middle and/or bottom guide bar employs a high denier per filament (dpf) yarn (at least 10 dpf). The high denier per filament yarns have filaments which are of a relatively large diameter relative to the total diameter of the yarn. As a result, such yarns are relatively less flexible and have a greater resistance to losing their shape after being heat set than yarns having a low denier per filament (less than 10 dpf). These high denier per filament yarns in the middle and/or bottom guide bars have excellent resistance to deformation after the fabric is heat set and impart excellent shape retention properties to the fabric.

The stitch construction is particularly selected so that the bottom and middle guide bars run in opposition to each other and each have an underlap length which extends between at least two wales. With such stitch construction, the fabric has a degree of stretch sufficient to enable the planar fabric to distend and conform to a three-dimensional mold, but a degree of stretch limited sufficiently so that the fabric will retain its shape and provide sufficient breast support after repeated wearing and laundering. Preferably, the stitch configuration of the bottom guide bar should be 1-0/1-2 and the stitch configuration of the middle guide bar should be 1-2/1-0. Alternatively, a stitch configuration of 1-0/2-3 may be employed in the bottom guide bar and 2-3/1-0 in the middle guide bar.

The top guide bar should preferably have the longest needle underlap length. It will therefore have only a minimal effect on the stretch characteristics of the fabric but will essentially control the aesthetics of the fabric, e.g. hand, feel, surface appearance and sheerness.

As the yarn in the top guide bar is predominate on the face and back sides of the fabric, the stitch construction and yarn of the top guide bar can cooperate to provide the fabric with a fine hand and a fine feel on the face and back sides of the fabric. The top guide bar should preferably run in opposition to the middle guide bar and preferably should have a stitch configuration of 1-0/2-3. It may, however, also employ, for example, a stitch configuration of 1-0/3-4.

The construction thus has the additional attribute of adaptability to varying aesthetic presentations since the stitch construction and yarn in the bottom and middle guide bars may remain the same for sheer, opaque and lace bra cups and only the yarn in the top guide bar need be varied to control the sheerness or opacity of the fabric. For example, to provide an opaque fabric and opaque bra cup, a 75 denier, 36 filament yarn may be employed in the top guide bar. However, for a relatively sheer fabric, the yarn employed in the top guide bar may be a 30 denier, 10 filament yarn or, for a very sheer fabric, the yarn may even be a 20 denier.

To provide a molded bra cup having a lace design, a lace pattern is knitted in with the three bar ground construction. The lace pattern is knitted using multibar lace configurations and is selected so that the gimp or outline yarns do not travel in a straight line direction but consist of a series of curved lines interconnecting the various lace designs formed by the fill-in yarns. The provision of a series of curved lines permits the lace fabric to more easily conform to the mold and a high degree of stretchability in the yarns is not required.

Thus, the present invention has discovered the basic components and the specific knitting configurations which are to be followed in order to provide a fabric which meets the objectives of molded brassiere cups; that is, comfort to the wearer and shape retention after laundering at least as good as or better than that of cut-and-sewn bra cups. Such a fabric is a heat-settable, thermoplastic fabric of warp knit construction knitted on at least three guide bars, including top, middle, and bottom guide bars with the middle and/or bottom guide bars having high denier per filament yarns (high being at least 10 dpf) knitted together into a particular knitted construction. While the constituents may have been individually known and, in fact, a fabric combining a form of the combination exists, the specific applicability of such fabric to molding, in general, and to the brassiere cup molding art in particular, has been heretofore unrecognized. Nor have the basic properties of such fabric, which may be modified to provide a basic substructure for use in a variety of molded brassiere cup types, been heretofore discovered.

Figure 3B:
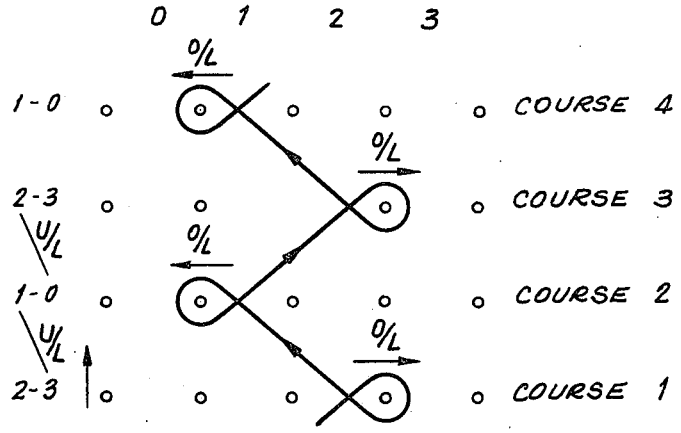
Figure 4:
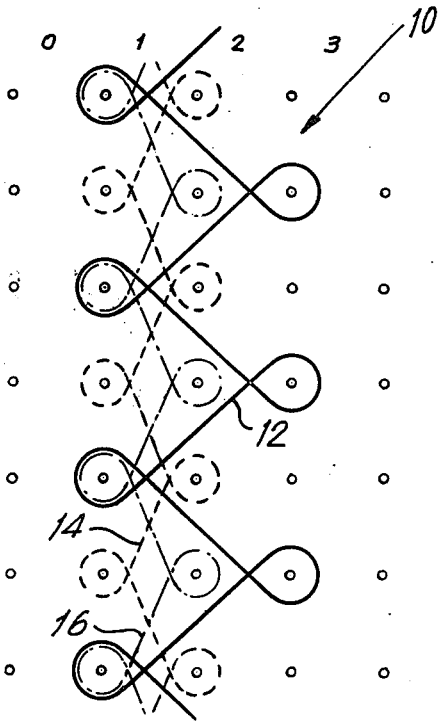
Figure 5:
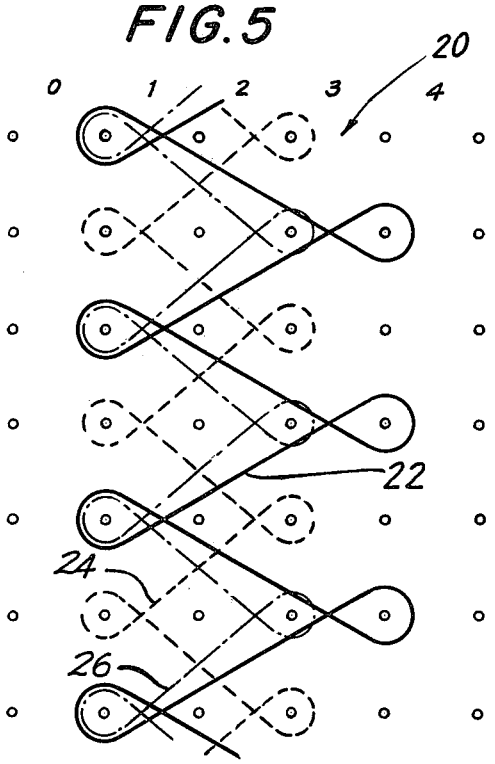
Figure 6:
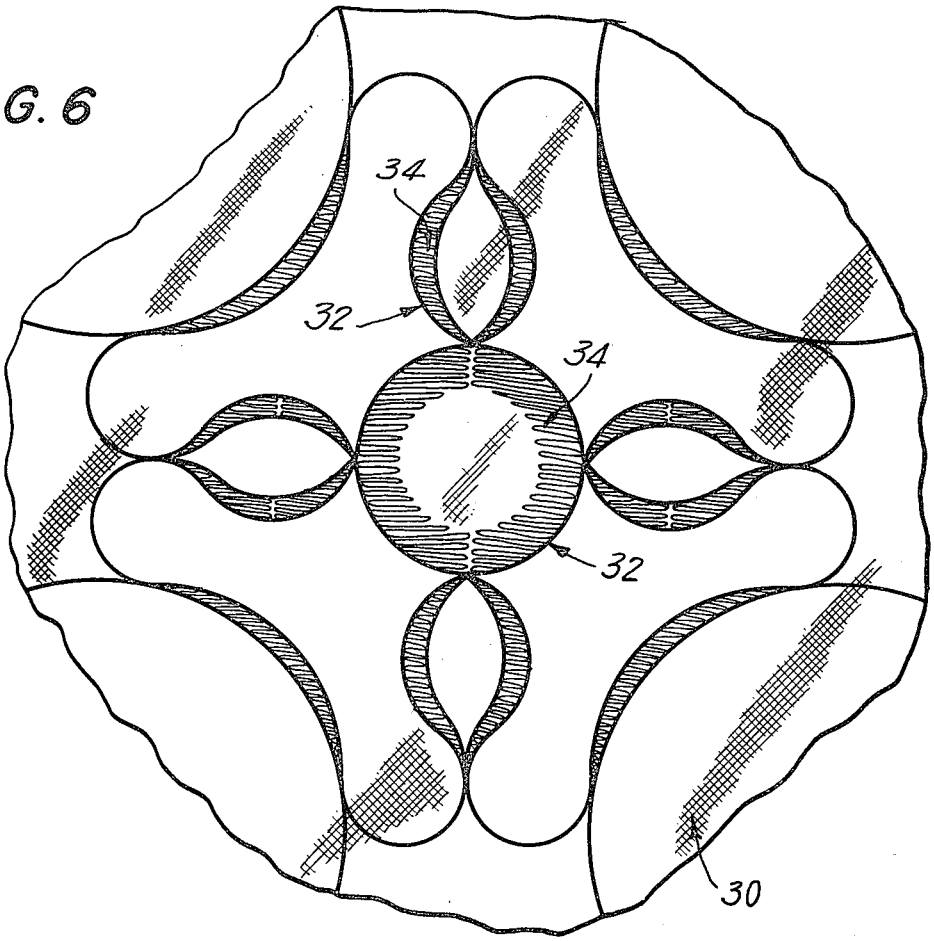
Figure 7:
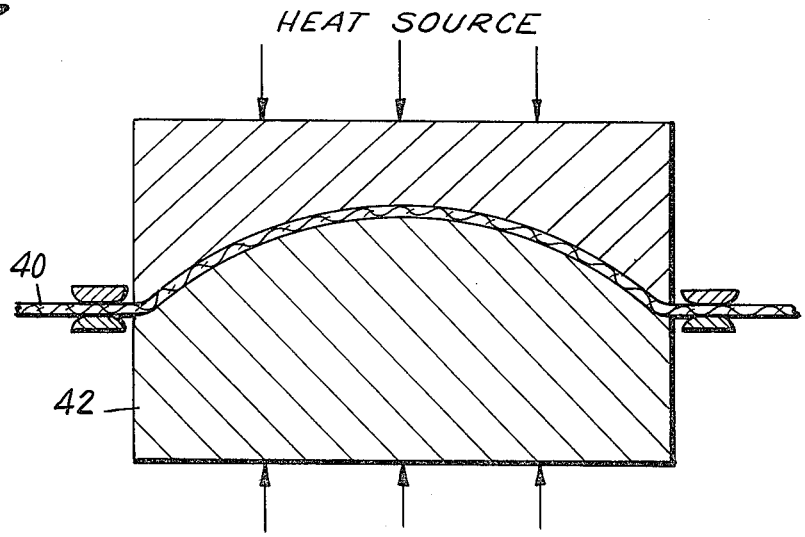

The above description as well as further features and advantages of the present invention will be more fully appreciated by reference to the following detailed description, when considered in conjunction with the accompanying drawings, wherein:

FIG. 1 is a perspective view of a brassiere having cups molded in accordance with the present invention;

FIGS. 2A and 2B diagramatically illustrate the preferred stitch constructions of the bottom and middle guide bars, respectively, of the fabric employed in the present invention for molding the brassiere cups shown in FIG. 1;

FIGS. 3A and 3B diagramatically illustrate an alternative stitch construction for the bottom and middle guide bars, respectively, of an alternative fabric which may be employed;

FIG. 4 diagramatically illustrates the stitch configuration for the preferred three-bar, warp knit fabric employed in the present invention for molding the brassiere cups shown in FIG. 1;

FIG. 5 diagramatically illustrates the stitch construction for an alternative three-bar, warp knit fabric;

FIG. 6 is a broken away, planar view of a fabric having a lace design in accordance with the present invention and which is employed for molding bra cups; and FIG. 7 illustrates a sectional view of a typical molding apparatus having a fabric according to the present invention being molded therein.

FIG. 1 illustrates a brassiere 50 which incorporates molded cups 52, having an opaque appearance. The brassiere so illustrated is merely representative of a bandeau brassiere known in the art. It will be appreciated that the brassiere illustrated is merely an example of one type of brassiere, and that the present invention has applicability generally to all types of brassieres.

As shown in FIG. 1, the cups 52 of the brassiere 50 are sewn into a basic brassiere frame which usually includes some type of bottom band 54, dorsal panels 56, shoulder straps 58, and a medial affixation arrangement between the cups, shown in FIG. 1 as cross tapes 60 and a triangular fabric insert 62.

The molded brassiere cups 52 encompass the three-dimensional breast tissue of the wearer and support the weight of the breast tissue. By and large it is also desirable that the brassiere cups impart uplift to the breasts, that is, raise them slightly for a more youthful presentation. As can thus be appreciated, a relatively substantial downward force is applied to the cups and that stretch, especially in the lower cup area, would deleteriously affect the desired performance of the brassiere.

As has been pointed out above, the stitch construction of the fabric of the present invention to a large extent controls the stretch characteristics of the fabric. While the stitch construction of the fabric in its planar state is important in determining the fabric's ability to stretch and conform to a three-dimensional mold, the degree of stretch must be limited sufficiently so that the degree of stretch retained after molding will withstand the forces applied by the breast during wear and the distortion effects of repeated laundering.

Referring specifically to the knitting procedure, the bottom and middle guide bars run in opposition to each other and each have an underlap length which extends between at least two wales. These requirements are met by a preferred construction in which: the stitch configuration of the bottom guide bar is 1-0/1-2 and the stitch configuration of the middle guide bar is 1-2/1-0.

The significance of these stitch construction requirements and the meaning of the textile notations will now be briefly explained in order to provide a clearer understanding of the present invention. Referring to FIG. 2A, there is shown the lapping movement of the bottom guide bar, and in FIG. 2B there is shown the lapping movement of the middle guide bar in opposition to the bottom guide bar. The drawing illustrates the guide movement as seen when looking down on the needle heads (represented by the rows of dots) and the lines show the paths traced out by an individual guide bar lapping around the needles. As is known in the textile arts, a number notation system is used to describe the lapping movement. The number notation system is based on denoting the overlap and underlap lengths in terms of needle intervals or wales covered by the guide bars. The direction of overlap and underlap is established by numbering either of their extremities as zero. Thus, in FIG. 2A, the left extreme of the movement located between needles A and B is arbitrarily assigned the zero number. Interval B-C is then the number 1, C-D, number 2 and so on. The lapping movement on course 1 can therefore be denoted as follows: the overlap is 1-0 meaning that the bottom guide bar moves left from interval 1 to 0; the underlap is 0-1 meaning that the bottom guide bar moves right from interval 0 to 1. The bottom guide bar has described one complete cycle of lapping movement and has wrapped the yarn around the needle from right to left. One cycle of movement produces one course.

The next cycle on course 2 involves identical movement but with the overlap and underlap in opposite directions to course 1. Accordingly, on course 2, the notation is: the overlap is 1-2 meaning that the bottom guide bar moves right from interval 1 to 2; the underlap is 2-1 meaning that the bottom guide bar moves left from interval 2 to 1. After completion of the second cycle, the sequence of lapping repeats itself. The construction then is said to have a two course repeat. It will be noticed that the amplitude of guide bar movement extends between two wales and has a single needle underlap length. A wale may be defined as the vertical column of stitches formed by the yarn wrapping around the needles. The complete notation for the two course repeat would be: 1-0, 0-1, 1-2, 2-1. This has been shortened by convention by simply eliminating the underlap notation. Therefore, the abridged notation is 1-0, 1-2 which still indicates, though indirectly, the underlaps as well as the overlaps. Thus, 1-0 is the overlap and 0-1 is the underlap. For the next course, 1-2 is the overlap and 2-1 the underlap. FIG. 2B shows the path traced out by the middle guide bar. The 0 number is established at the left extremity of the lapping movement (interval F-G). The lapping movement on course 1 is denoted as follows: overlap 1-2 meaning that the middle guide bar moves right from interval 1 to 2; underlap 2-1 meaning that the middle guide bar moves left from interval 2 to 1. On course 2, the notation is: overlap 1-0 meaning that the middle guide bar moves left from interval 1 to 0; underlap 0-1 meaning the middle guide bar moves right from interval 0 to 1. The complete notation for the 2-course repeat would be: 1-2, 2-1, 1-0, 0-1, which in abridged form is 1-2, 1-0.

The final notation covering the stitch construction of the bottom and middle guide bars is: bottom guide bar: 1-0, 1-2; middle guide bar: 1-2, 1-0. As noted, the bottom guide bar in FIG. 2A and the middle guide bar in FIG. 2B have lapping movements in opposition to each other. That is, in Course 1 of the bottom and middle guide bars, the overlap direction of the bottom guide bar is from right to left whereas the overlap direction of the middle guide bar is from left to right. Similarly, comparing course 2 of the bottom and middle guide bars, it is seen that the overlap direction of the bottom guide bar is from left to right whereas the overlap direction of the middle guide bar is from right to left. This is simply denoted by indicating that the bottom and middle guide bars have lapping movements which run in opposition to each other. However, there are two important similarities between the bottom and middle guide bars. Each of the guide bars has the same single needle underlap length, i.e., the underlap length extends between two wales. In addition, the bottom and middle guide bars each have stitch constructions which repeat themselves on two courses. These attributes, that is lapping movements in opposition; the same single needle underlap length and the two course repeat are all stretch control factors.

It has been found that a three guide bar fabric having such stitch constructions in the bottom and middle guide bars and which employ the yarns herein before described yield a fabric which has a degree of stretch sufficient to enable the fabric to distend and conform to a three-dimensional mold, without retaining after molding and heat setting so high a degree of stretch that the molded brassiere cup will lose its shape and supportive characteristics after repeated wearing and laundering.

Alternatively, a different stitch configuration may be employed in the bottom and middle guide bars and still meet the requirements set out above. As shown in FIG. 3A, a stitch configuration of 1-0/2-3 may be employed in the bottom guide bar, and as shown in FIG. 3B, a stitch configuration of 2-3/1-0 may be employed in the middle guide bar. As these stitch configurations follow the number notation system explained above, it need not be repeated in detail. Again, the bottom and middle guide bars have lapping movements which run in opposition to each other. In the FIGS. 2A and B constructions, the bottom and middle guide bars have the same single-needle underlap length which extends between two wales. However, in the FIGS. 3A & B construction, the bottom and middle guide bars both have the same two-needle underlap lengths which extend between three wales. While this difference in the stitch construction shown in FIGS. 3A & B will give slightly greater stretch characteristics to the fabric produced, it has been found that the FIGS. 2A & B and FIGS. 3A & B stitch constructions of the bottom and middle guide bars produce fabrics having stretch characteristics within the desired range to meet the requirements for brassiere cup moldability and shape retention.

However, if the bottom and middle guide bars have underlap lengths which extend between more than three wales, the stretch characteristics of the fabric would be altered to such an extent that this would adversely affect the fabric's degree of moldability.

Referring to the top guide bar, it preferably has the longest needle underlap length so it will have a minimal effect on the stretch characteristics of the fabric and will primarily control the aesthetic properties of the fabric. This provides an added commercial advantage in that the stitch constructions and yarns in the bottom and middle guide bars may remain the same for sheer, opaque, and lace bra cups with only the yarn in the top guide bar having to be modified if greater or lesser sheerness or opacity of the finished brassiere cup is desired. Preferably, the top guide bar runs in opposition to the middle guide bar and, following the notation system set forth above, preferably should have a stitch configuration of 1-0/2-3. Alternatively, the top bar may employ a stitch configuration of 1-0/3-4. Since the stitch configurations of the top guide bar provide underlap lengths which are at least as long as or are longer than the underlap lengths in the bottom and middle guide bars, it is the bottom and middle guide bars which substantially determine the stretch characteristics of the fabric.

The stretch characteristics of the fabric may also be varied by how tightly or loosely the fabric is knit. Preferably the outer ranges of looseness and tautness of knitting should be avoided. To determine if the knitted fabric to be molded has been knitted within preferable ranges, the fabric may be placed under magnification and examined. Preferably, the underlaps between stitches should be generally straight or only slightly curvilinear, with little or no slack, and the knitted stitches or loops should be substantially pear-shaped.

Referring to FIG. 4, there is diagramatically shown a fabric 10 knitted in accordance with the teachings of the present invention. Fabric 10 is a heat settable, polyester fabric of warp knit construction, knitted on three guide bars. There is a top guide bar yarn 12 (diagrammatically represented by solid lines), a middle guide bar yarn 14 (diagrammatically represented by dotted lines) and a bottom guide bar yarn 16 (diagrammatically represented by dot-dash lines). Yarns 14 and 16 are 20 denier monofilament polyester yarns. The bottom and middle guide bars have the stitch construction shown in FIGS. 2A & B, respectively. That is, the stitch configuration of the bottom guide bar yarn 16 is 1-0/1-2 and the stitch configuration of the middle guide bar yarn 14 is 1-2/1-0. The top guide bar runs in opposition to the middle guide bar and has a stitch configuration of 1-0/2-3. Top guide bar yarn 12 may be varied to control the sheerness or opacity of the desired bra cup. In fabric 10, an opaque bra cup is shown and a 75 denier, 36 filament polyester yarn 12 has been found most suitable for the desired opacity. For a sheer fabric, the yarn 12 in the top guide bar may be a 30 denier, 10 filament polyester yarn or, for an even sheerer fabric, a 20 denier polyester yarn may be employed.

Referring to FIG. 5, there is diagrammatically shown an alternative fabric 20 having the characteristics of the present invention. Fabric 20 is a heat settable, polyester fabric of warp knit construction, knitted on three guide bars. There is a top guide bar yarn 22 (solid lines), a middle guide bar yarn 24 (dotted lines) and a bottom guide bar yarn 26 (dot-dash lines). Yarns 24 and 26 are 20 denier monofilament polyester yarns. The bottom and middle guide bars have the stitch constructions shown in FIGS. 3A and 3B, respectively. That is, the stitch configuration of the bottom guide bar yarn 26 is a 1-0/2-3 and the stitch configuration of the middle guide bar yarn 24 is 2-3/1-0. The top guide bar runs in opposition to the middle guide bar and has a stitch configuration of 1-0/3-4. Top guide bar yarn 22 may be varied as heretofore described with, for example, a 75 denier, 36 filament polyester yarn 22 for an opaque bra cup; a 30 denier, 10 filament polyester yarn for a sheer cup or, for an even sheerer cup, a 20 denier polyester yarn.

Unlike the basic problem of too much stretch which is present in prior attempts to make opaque and sheer molded cups, an opposite problem has been found with respect to molded lace cups. The gimp yarns of a typical lace pattern generally run in straight line directions, with relatively long fill-in yarns. By modifying the lace pattern construction and incorporating the basic teachings of the present invention relative to fabric characteristics, this problem has been overcome. As shown in FIG. 6, the novel lace pattern is knitted in with the three bar ground construction preferably using multibar lace configurations. The top, middle and bottom guide bar yarns may be employed as the ground or base fabric 30 upon which a suitable lace pattern is knitted. The lace pattern includes gimp or outline yarns 32 and fill-in yarns 34. The pattern is pre-selected so that the gimp or outline yarns as knitted in with the base fabric are not in straight-line directions. Instead, the gimp yarns extend in curvilinear directions interconnecting the various lace designs formed by the fill-in yarns. Although the fill-in yarns extend in straight-line directions, they are limited in length, e.g., in the order of ⅜. It has been found that such a construction permits the lace fabric to have the required give or stretch characteristics so that it will readily conform to the mold.

Once any of the fabrics heretofore described has been knitted, the molding process employed may be conventional, such as shown in U.S. Pat. No. 3,434,478 to B. Liebowitz, and need be only briefly described. As shown in FIG. 7, the planar fabric 40 is clamped in place in a molding apparatus and a male mold 42 is employed to shape the planar fabric into a bra cup by heat setting. The heat set temperature during molding is in the range of 300° F. to 425° F. The time duration for heat setting and shaping the fabric is in the range of 15 to 100 seconds. The male mold is allowed to cool and then retracted. The shaped fabric is then unclamped, trimmed about its edges, if necessary, and then sewn into a brassiere frame such as the representative sample shown in FIG. 1.

Although this invention has been described with respect to its preferred embodiments, it should be understood that many variations and modifications will now be obvious to those skilled in the art, and it is intended, therefore, that the scope of the invention be limited, not by the specific disclosure herein, only by the appended claims.

What is claimed is:

1. A molded three-dimensional breast cup for a brassiere comprising a warp knit fabric of thermoplastic yarns throughout, said fabric being at least a three guide bar fabric, including top, middle and bottom guide bar yarns having a denier per filament of at least 10, said bottom and middle guide bar yarns being in opposition to each other and each having underlap lengths which extend at least two wales, but not more than three wales, said fabric having a degree of stretch sufficient to enable said fabric to distend during molding from an initially planar condition to a three-dimensional configuration, and in which said warp knit fabric yarns form stitches with overlaps and underlaps that are substantially dimensionally stabilized, said fabric top bar yarns appearing on both surfaces of the molded breast cup for soft molded fabric surfaces.

2. A molded three-dimensional breast cup for a brassiere as claimed in claim 1, with said underlaps of said bottom and middle guide bar yarns being of equal length.

3. A molded three-dimensional breast cup for a brassiere as claimed in claim 1 wherein said bottom and middle guide bar yarns are 20 denier monofilament yarns.

4. A molded three-dimensional breast cup for a brassiere as claimed in claim 1 wherein said bottom guide bar yarn has a stitch configuration of 1-0/1-2 and said middle guide bar yarn has a stitch configuration of 1-2/1-0.

5. A molded three-dimensional breast cup for a brassiere as claimed in claim 1 wherein the bottom guide bar yarn has a stitch configuration of 1-0/2-3 and the middle guide bar yarn has a stitch configuration of 2-3/1-0.

6. A molded three-dimensional breast cup for a brassiere as claimed in claim 1 wherein the warp knit fabric includes a lace design having gimp yarns which all extend in substantially curvilinear directions.

7. A molded three-dimensional breast cup for a brassiere comprising a warp knit fabric of thermoplastic yarns throughout, said fabric being a three guide bar fabric, including top, middle and bottom guide bar yarns, the middle and bottom guide bars having a denier per filament of at least 10, said bottom and middle guide bar yarns being in opposition to each other and having equal underlap lengths which extend two wales, said fabric having a degree of stretch sufficient to enable it to distend during molding from an initially planar condition to a three-dimensional configuration, and in which the warp knit fabric yarns form stitches with overlaps and underlaps that are substantially dimensionally stabilized, said fabric top bar yarns appearing on both surfaces of the molded breast cup for soft molded fabric surfaces.

* * * * *